US006460470B1

(12) United States Patent
Scharer et al.

(10) Patent No.: US 6,460,470 B1
(45) **Date of Patent: *Oct. 8, 2002**

(54) MODULAR INTERIOR FURNISHING SYSTEM

(75) Inventors: Alexander Scharer, Bern; Florin Baeriswyl, Zurich, both of (CH)

(73) Assignee: USM U. Scharer Sohne AG, Munsingen (CH)

( * ) Notice: Subject to any disclaimer, the term of this patent is extended or adjusted under 35 U.S.C. 154(b) by 0 days.

This patent is subject to a terminal disclaimer.

(21) Appl. No.: 09/715,189

(22) Filed: Nov. 20, 2000

Related U.S. Application Data

(62) Division of application No. 09/194,017, filed as application No. PCT/CH97/00216 on May 29, 1997, now Pat. No. 6,220,186.

(30) Foreign Application Priority Data

May 29, 1996 (DE) ..... 196 21 547

(51) Int. Cl.[7] ..... A47B 13/00
(52) U.S. Cl. ..... 108/153.1; 108/50.01
(58) Field of Search ..... 108/153.1, 50.01, 108/50.02, 64, 158.12, 158.13; 312/195, 196, 194, 257.1, 223.3

(56) References Cited

U.S. PATENT DOCUMENTS

| | | | |
|---|---|---|---|
| 3,538,862 A | 11/1970 | Patriarca | |
| 3,664,063 A | 5/1972 | Ware | |
| 3,853,074 A | 12/1974 | Madey | |
| 3,960,275 A | 6/1976 | Haughton et al. | |
| 4,463,057 A | 7/1984 | Knurr | |
| 4,469,232 A | 9/1984 | Lusch | |
| 4,501,512 A | 2/1985 | Hiltz | |
| 4,615,279 A | 10/1986 | De La Haye | 108/64 X |

(List continued on next page.)

FOREIGN PATENT DOCUMENTS

| | | |
|---|---|---|
| DE | 24424791 A1 | 3/1975 |
| DE | 74382948 | 5/1975 |
| DE | 7423372 | 3/1976 |

(List continued on next page.)

*Primary Examiner*—Jose V. Chen

(57) ABSTRACT

A modular interior fittings system includes several different functional units such as carcasses, work surfaces, separating wall boards, lighting fixtures, presentation racks, etc. and at least one uniform statically stable structural element. The structural element is designed as an independent, vertical, closed rectangular frame. For stabilization purposes in its vertical position, a chassis that stretches vertically to the frame plane is mounted on the bottom of the frame and/or a corner connection is installed to a second neighboring frame. The functional units are installed in such a way that they reach through the plane created by the frame. The frame has vertical lengthwise sleepers with grooves or ribs to fasten the functional units at a selected height. To stow cables, conduits or grooves are provided for in the frame. Preferably the corner connections have an angle grid so that neighboring frames can be connected with each other at selected angle positions, which however are specified in size. A carcass is preferably installed in the lower area of the frame for stabilization.

36 Claims, 11 Drawing Sheets

U.S. PATENT DOCUMENTS

| | | | | |
|---|---|---|---|---|
| 4,657,149 | A | | 4/1987 | Masson |
| 4,712,842 | A | | 12/1987 | Price et al. |
| 4,727,994 | A | | 3/1988 | Beaulieu |
| 4,748,913 | A | | 6/1988 | Favaretto et al. ..... 108/64 X |
| 4,852,500 | A | | 8/1989 | Ryburg et al. |
| 4,879,955 | A | | 11/1989 | Moll et al. ..... 108/50.02 X |
| 4,914,873 | A | | 4/1990 | Newhouse |
| 5,037,164 | A | | 8/1991 | Weissenbach et al. ..... 108/50.02 X |
| 5,116,264 | A | | 5/1992 | Wiederrich et al. |
| 5,473,994 | A | | 12/1995 | Foley et al. ..... 108/50.02 |
| 5,522,324 | A | | 6/1996 | Van Gelder et al. |
| 5,606,919 | A | | 3/1997 | Fox et al. ..... 408/50.02 |
| 5,606,920 | A | * | 3/1997 | Meyer et al. ..... 108/50.02 |
| 5,623,881 | A | | 4/1997 | Huang ..... 108/50.01 |
| 5,704,298 | A | | 1/1998 | Corpuz, Jr. et al. ..... 108/50.01 |
| 5,715,760 | A | | 2/1998 | Frascaroli et al. ..... 108/50.02 |
| 5,909,713 | A | | 6/1999 | Liaw ..... 108/153.1 X |
| 5,967,631 | A | | 10/1999 | Ko ..... 108/50.01 |
| 6,220,186 | B1 | * | 4/2001 | Scharer et al. ..... 108/153.1 |

FOREIGN PATENT DOCUMENTS

| | | | |
|---|---|---|---|
| DE | 7509392 | | 4/1976 |
| DE | 7520557 | | 4/1976 |
| DE | 2615234 | A1 | 10/1977 |
| DE | 2615235 | A1 | 10/1977 |
| DE | 7719549 | | 10/1977 |
| DE | 2709868 | A1 | 9/1978 |
| DE | 0006707 | A1 | 1/1980 |
| DE | A1-2848929 | | 5/1980 |
| DE | 3148504 | C2 | 8/1984 |
| DE | 3153126 | C2 | 12/1987 |
| DE | 3133459 | C2 | 4/1988 |
| DE | 90014375 | | 5/1990 |
| DE | 4004200 | A1 | 8/1991 |
| DE | U-9208315 | | 9/1992 |
| DE | 94086761 | | 10/1994 |
| DE | 295164566 | | 2/1996 |
| DE | 4436842 | A1 | 4/1996 |
| EP | 0345754 | A2 | 12/1989 |
| EP | A1-458264 | | 11/1991 |
| EP | 0331976 | B1 | 2/1992 |
| FR | 1130027 | | 10/1968 |
| FR | A2-638885 | | 5/1990 |
| FR | 2638885 | | 11/1998 |
| JP | 56057409 | | 5/1981 |
| JP | 56100075 | | 8/1981 |
| JP | 58005839 | | 1/1983 |
| JP | 03048567 | | 5/1991 |
| JP | 5001008 | | 1/1993 |
| WO | 9416597 | | 8/1994 |
| WO | 9419850 | | 9/1994 |

* cited by examiner

MODULAR INTERIOR FURNISHING SYSTEM

This application is a divisional of co-pending application Ser. No. 09/194,017, filed on Nov. 19, 1998. application Ser. No. 09/194,107 is now U.S. Pat. No. 6,220,186 issued on Apr. 24, 2001. Application Ser. No. 09/194,017 is the national phase of PCT International Application No. PCT/CH97/00216 filed on May 29, 1997 under 35 U.S.C. §371. The entire contents of each of the above-identified applications are hereby incorporated by reference.

STATE OF THE ART

The development of, and changes to, work places continue steadily. It has to be taken into consideration that not only do new work environments (e.g. due to the development of data processing and telecommunications) arise, but that also existing work place fittings should be adjusted to the changing tasks of a work team. Based on this background, it is desirable for the manufacturer and provider of furniture or entire fittings to have a system at hand which enables them to satisfy different needs and which can also be changed after it has been set up (i.e. at a later time) without problems.

The need for an flexible interior fittings system has existed for a long time. Accordingly, a variety of suggestions is available. It has become obvious, however, that most known system solutions are heavily orientated to one application (e.g. subdivision of large office areas, manufacturing of show pieces, shelving systems, etc.).

From documents GM-74 23 372 and GM-75 09 392 we know, e.g., shelving systems where vertical support sleepers are fastened between the floor and the ceiling or on the wall of a room as statically stable structural elements in order to then be able to install rack plates, box elements or containers. The German registered design GM-75 20 557, for example, deals with a wainscot wall that has a base piece so that it can be set up freely in the room. The vertical supports have a certain hole layout so that box elements can be hung at a chosen height.

We know of shelving systems for trade shows from the two publications GM-90 01 437.5 and GM-94 08 676.1. They can be set up in a room—free-standing—and offer the possibility of arranging storage shelves, small tables or hooks as required. According to GM-90 01 437.5, several vertical supports with feet are connected with other through cross-girders. The shelves are fastened from the front as they would on a wall shelving system. GM-94 08 676.1 plans for a large rectangular frame design where vertical support tubes can be inserted to fasten shelves, etc. Similar to GM-90 01 437.5, all functional elements protrude to the front. And finally, a large number of wall elements are known for dividing and furnishing rooms (e.g. DE40 04 200 A1, DE-24 42 479 A1, EP-0 345 754, U.S. Pat. No. 4,727,944, DE-26 15 235 A1, U.S. Pat. No. 4,657,149).

SUMMARY OF THE INVENTION

It is the task of the invention to design a modular interior fittings system of the kind described at the beginning which distinguishes itself through its functional variety and which enables the set-up of interior fitting arrangements of high static stability at simultaneous maximum modularity.

Since the structural element is designed as a closed rectangular frame, high stability and torsional stiffness are ensured. The frame is, e.g., 2 m (79 inches) high and 75 cm (30 inches) wide and set up vertically. The functional units (particularly the table tops or work surfaces, the shelving or storage areas and the containers or carcasses etc.) are installed into the frame in such a way that they reach through the plane created by the frame. This avoids among other things too high a load on one side. To stabilize the frame elements in vertical position, a chassis, for example, that stretches vertically to the frame plane is installed on the bottom of the frame. It can be equipped with feet (or sliders) or rollers. Several frames can be connected with each other at an angle via corner connections so that for certain applications (acoustical separating walls or similar) the chassis on the bottom can be done without.

According to a preferred version, the frame has vertical lengthwise sleepers with grooves or ribs to fasten the functional units at any selected height. Also feasible are lengthwise rails with a hole or slot grid so that the fastening can occur with suitable hanging system elements.

If the lengthwise sleepers are designed in such a way that the functional elements can be mounted at any height, the fastening of table tops in exact horizontal alignment can be a laborious task because it requires the use of a ruler or level. To facilitate assembly, for example, a profile insert (e.g. a strip of plastic), which has small notches or nubs at regular intervals, can be integrated into the fastening groove. A fastening element that catches the groove can snap slightly into the notch so that the user has an orientation possibility for the adjusted assembly. We have to stress that the grid of the profile insert in no way limits the freedom of attaching the fastening element at any selected height. It is also possible to fix one element between two grid positions without problems. The grid therefore only represents a kind of integrated ruler that can be used as required. For both aesthetic and practical reasons, it is beneficial if the frame is equipped with conduits for cables and/or wires. This way the frame and the entire interior fittings system can be supplied elegantly with electricity and/or equipped for data communication. It is not absolutely necessary that all four sides of the frame have cable conduits. It could possibly be sufficient if one or two lengthwise sleepers and perhaps one narrow side are equipped with such conduits.

According to one particularly preferred version, a conductor rail is integrated into a lengthwise conduit of the frame, where at least two conductors planned for current-carrying are arranged. The conductor rail is accessible via a lengthwise slot in the profile support (frame). With a suitably designed plug, the conductors can be contacted at any location. For safety reasons, the conductors are arranged in the conduit in such a way that they cannot be touched without difficulty (e.g., it should not be possible to touch the current-carrying conductors with a screwdriver).

The frame (particularly the lengthwise sleeper) has, for example, an S-shaped or Z-shaped profile. This profile is axially symmetrical and forms both the fastening groove and the cable conduit. The diagonal support or connecting piece of the S-shaped profile can have double walls to increase stability. The Z-shaped and/or S-shaped profile can (in its cross-section) have a round or square outer shape. Basically, however, any cross-section shapes are possible (regular polygons such as triangles, hexagons, heptagons, but also asymmetrical shapes such as L-shape, or similar).

The frame can consist of side pieces that are screwed or welded together. Preferably, the lengthwise sleepers are designed as vertical hollow sections (e.g. of the kind as described above). As narrow sides of the frame serve, for example, cross-bows that are connected rigidly with the hollow sections. Good stability can be achieved by fastening the cross-bows with screws or clamping and/or straddle wedge elements, which catch the lengthwise sleepers at the end.

The chassis can have various shapes. In the plane vertical to the frame plane, it can, for example, form an H-shaped design on the end of which feet, gliders or rollers can be installed. Another possibility consists of fastening a bottom plate underneath the frame. Since such a plate has no protruding legs, it also minimizes the risk of someone tripping over the chassis. (This is particularly important, e.g., for rooms accessible to the public).

It is beneficial if a carcass is built onto the chassis. Through its weight it increases the vertical frame's stability. The height of the carcass can be determined as needed. Beyond that, table tops, separating wall plates, presentation racks, screen fastenings and/or equipment fastening can be provided for. Another frame can be added (aligned or at an angle different from 180°) on the side to such a stabilized structural element. The corner connection used for that can, e.g., be inserted on the connecting area between the lengthwise sleeper and the bow. The connecting elements can be prefabricated single-piece moldings that define a certain connection angle. I.e. the furniture system comprises a number of different connecting elements, which are utilized as needed by the user. It is also possible, however, to provide for a single molding that can be fastened in various angular positions on the corners of the frame. In this connection, it is of advantage if the corner connection has an angled grid (e.g. 15° grid) to ensure good stability.

Based on the structural element in accordance with the invention, a most diverse variety of interior fittings (work places in the office, workshop and service areas) can be set up. It also allows the selection and utilization of individual pieces of furniture (carcasses, boxes, separating walls) for special applications without difficulty.

The following detailed description and summary of patent claims shows other advantageous versions and combinations of features of the invention.

BRIEF DESCRIPTION OF THE DRAWINGS

The drawings used to explain the examples of the versions show.

As a rule, identical parts are marked with identical references in the drawings.

DETAILED DESCRIPTION OF DRAWINGS

Figure 1:
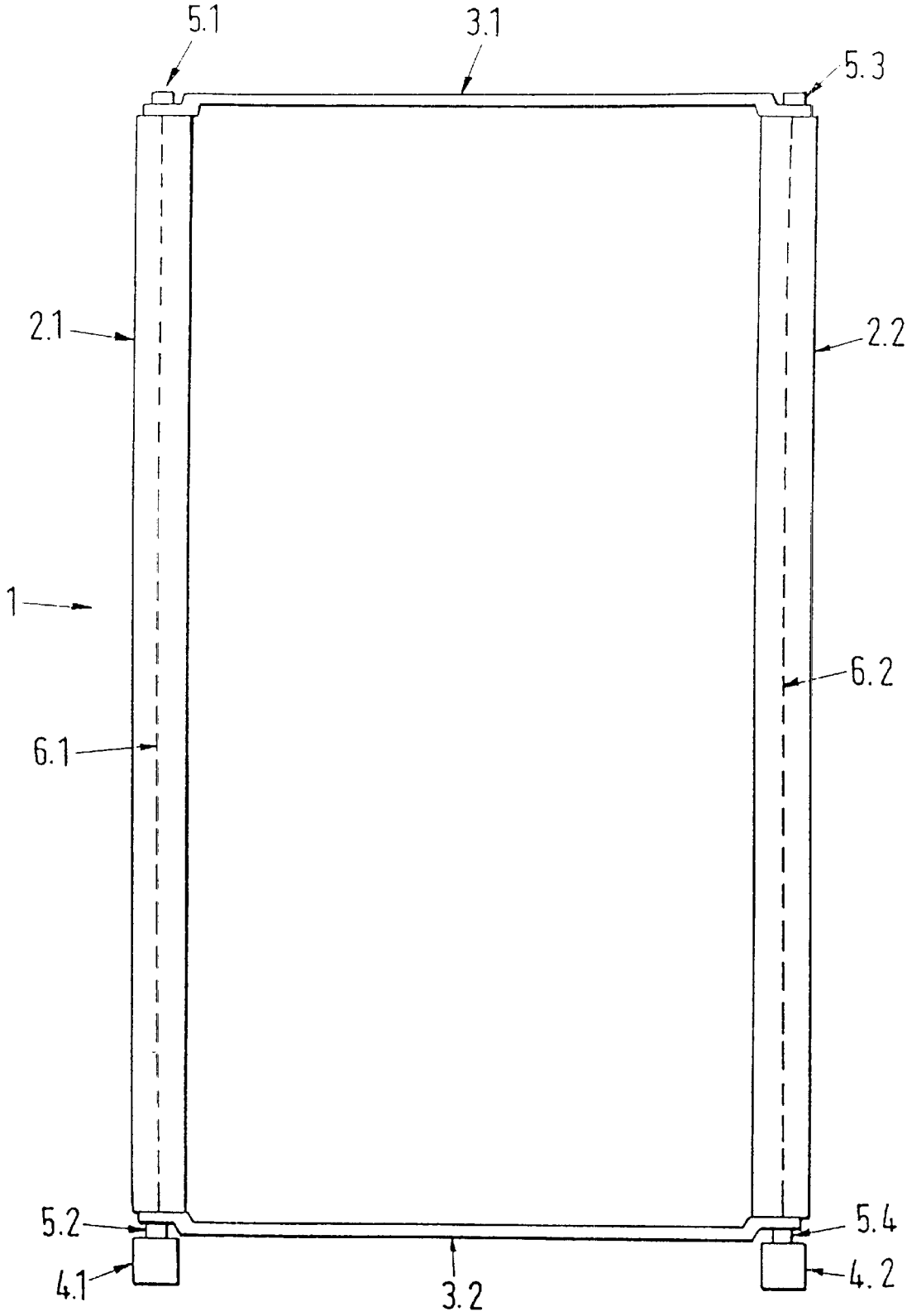
FIG. 1 Is an illustration of a frame in accordance with the invention.

FIG. 1 shows an example of frame 1, which serves as a statically stable structural element to the interior fittings system in accordance with the invention. It consists, e.g., of two vertical lengthwise sleepers 2.1, 2.2 and two bows 3.1, 3.2 connecting them horizontally. On the lower corners (quasi extension of the lengthwise sleepers 2.1, 2.2), for example, two sliders 4.1, 4.2 are affixed.

The lengthwise sleepers 2.1, 2.2 are, for example, straight hollow sections. The bows 3.1, 3.2 are preferably solid, flat (and also straight) rods which, on both ends, are step-like offset sideways from the longitudinal axis of the rod. Tension screws 5.1 to 5.4, for example, are provided for the rigid connection of the bows 3.1, 3.2 with the lengthwise sleepers 2.1, 2.2; these screws catch the open ends of the lengthwise sleepers 2.1, 2.2. The tension screws 5.1 to 5.4 are, for example, screwed into axially running thread bores of the lengthwise sleepers 2.1, 2.2.

The lengthwise sleepers 2.1, 2.2 and the bows 3.1, 3.2 therefore create a rectangular surface or plane. With regard to this plane, the profiles of the frame are aligned in such a way that the direction of the larger cross-section dimension is vertical to the frame plane.

In the example presented, the bows 3.1, 3.2 have different (i.e. flatter) profiles than the lengthwise sleepers 2.1, 2.2. It is beneficial—but not absolutely necessary—if the bows 3.1, 3.2 are hollow for the installation of cables and wires. Accordingly, the lengthwise sleepers 2.1, 2.2 should also have open longitudinal grooves or conduits (if necessary, with locks or covers).

An interior fittings system in accordance with the invention is preferably based on one or two such frame elements of the same or different dimensions. It is also feasible, for example, to make a large frame element (height 1.8 to 2.2 m=71 to 87 inches, width 0.7 to 1.0 m=28 to 40 inches) available for shelves, separating walls, stand-up workplaces etc. and a smaller frame element (height e.g. 1.2 to 1.6 m=47 to 63 inches, width 0.4 to 0.6 m=16 to 24 inches) for mobile functional units, such as personal roller carcasses, presentation units, etc. Limiting the structure to one or two frame elements of a specified size and similar design provides not only a visual standardization of the functionally different units, but also simplifies the entire planning and design process of interior fittings.

The vertical lengthwise sleepers 2.1, 2.2 are preferably equipped with function-specific features (e.g. longitudinal grooves or ribs, openings, rows of holes) that serve to fasten various functional elements at a selected height. Of course the lengthwise sleepers can also be formed by closed (in cross-section) rectangular tubes or by T-profiles or double-T profiles. For aesthetic reasons it is desirable if the fastening elements catch only one or two sides of the profile (and do not have to embrace it from three sides).

Figure 2:
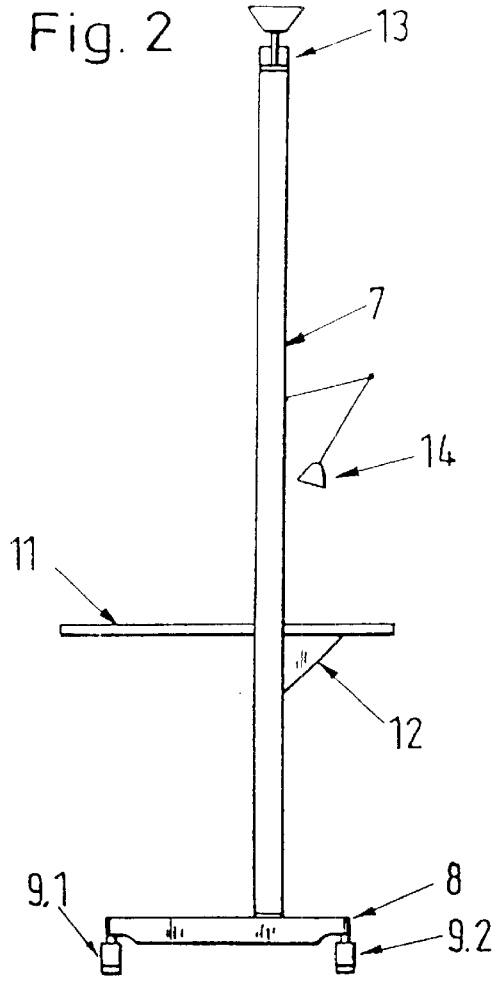
FIG. 2 Is an illustration of a piece of furniture with a work surface.

FIG. 2 shows an example of a simple work place on the basis of the large vertical frame 7. It is stabilized with a chassis 8 (which stretches vertically to the plane created by the frame 7). The chassis 8, e.g, has feet 9.1, 9.2 extensions. Instead of the feet 9.1, 9.2, stoppable rollers can also be provided for so that the entire work place is mobile.

In the frame 7 a work surface 11 (small table top) is installed at a suitable height (e.g. 70 to 80 cm=28 to 32 inches above the ground—depending on the type of the work place). It reaches through the vertical plane created by the frame 7. To stabilize the work surface 11, a diagonal or triangular bracing element 12 can be provided for. (A preferred way of fastening the table top is explained below in connection with FIG. 12).

On the cross-bow 13 of the frame 7, for example, a lamp 14 is attached. Electrical supply fixtures can be hidden in the frame 7. To fasten the lamp 14, basically an element standardized for the presented furniture system can be used, as is explained below in FIGS. 6 and 12. I.e., a clamping element is equipped with a coupling block that is suitable for various kinds of applications (fastening of a table top, shelf, lamp, etc.).

Figure 3:
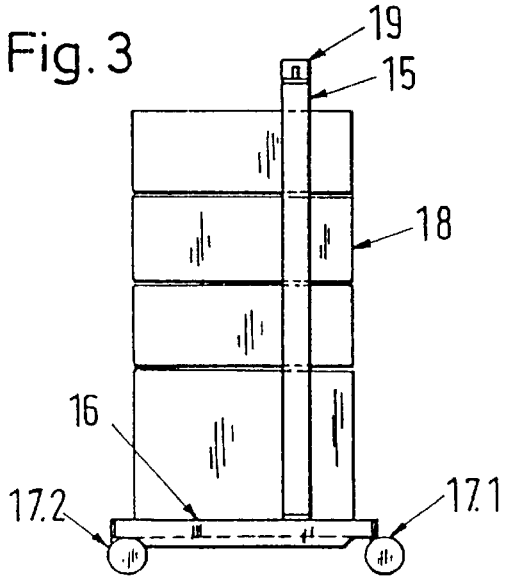
FIG. 3 Is an illustration of a mobile container-type piece of furniture.

FIG. 3 shows a mobile functional unit (same scale as in FIG. 2). The frame 15 is, e.g., only 150 cm (59 inches) high and has a chassis 16 with rollers 17.1, 17.2. The carcass 18, for example, is a modular assembly of several boxes and fills in almost the entire height of the frame 15. It is placed so that it reaches through the plane created by the frame 15. It can also be connected with the vertical lengthwise sleepers of the frame 15. The cross-bow 19 can serve as a handle when moving or rolling the roller furniture.

The units shown in FIGS. 2 and 3 have a uniform appearance due to the similar execution of the two frames 7 and 15 (differing only in height).

The unit shown in FIG. 3 can be set up as a personal file cabinet or also as a rolling computer cart. In the second case, the computer and printer, for example, would be arranged on the bottom part and the monitor on top. The monitor can, e.g., be set up on a tilting panel or mounting device of the rolling cart.

Figure 4A:
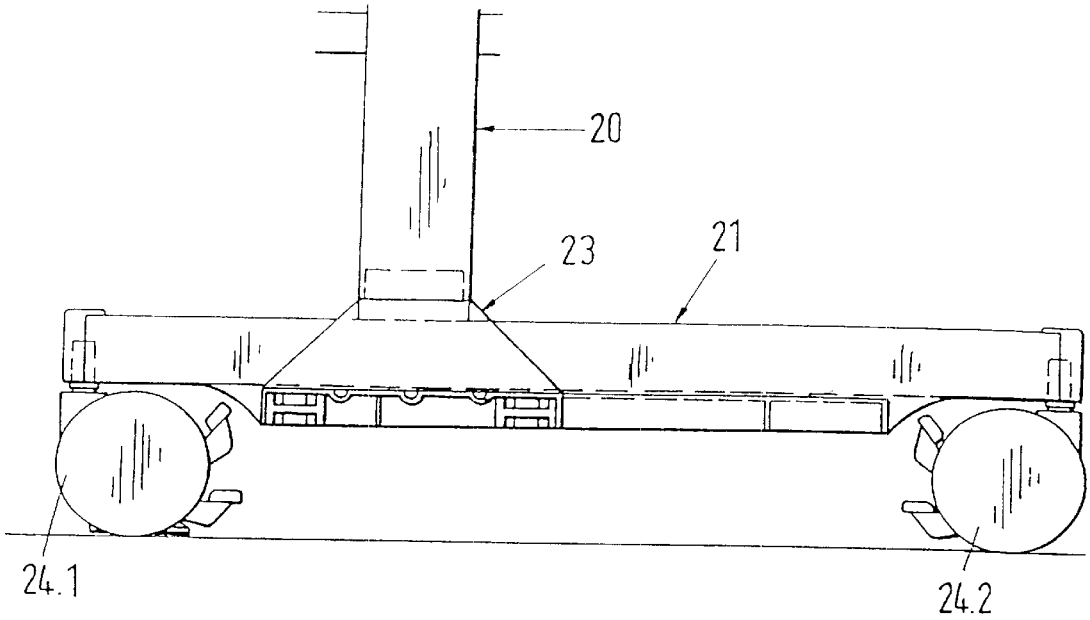
FIGS. 4*a, b* Is an illustration of a chassis on wheels from the side view and the top view.
Figure 4B:
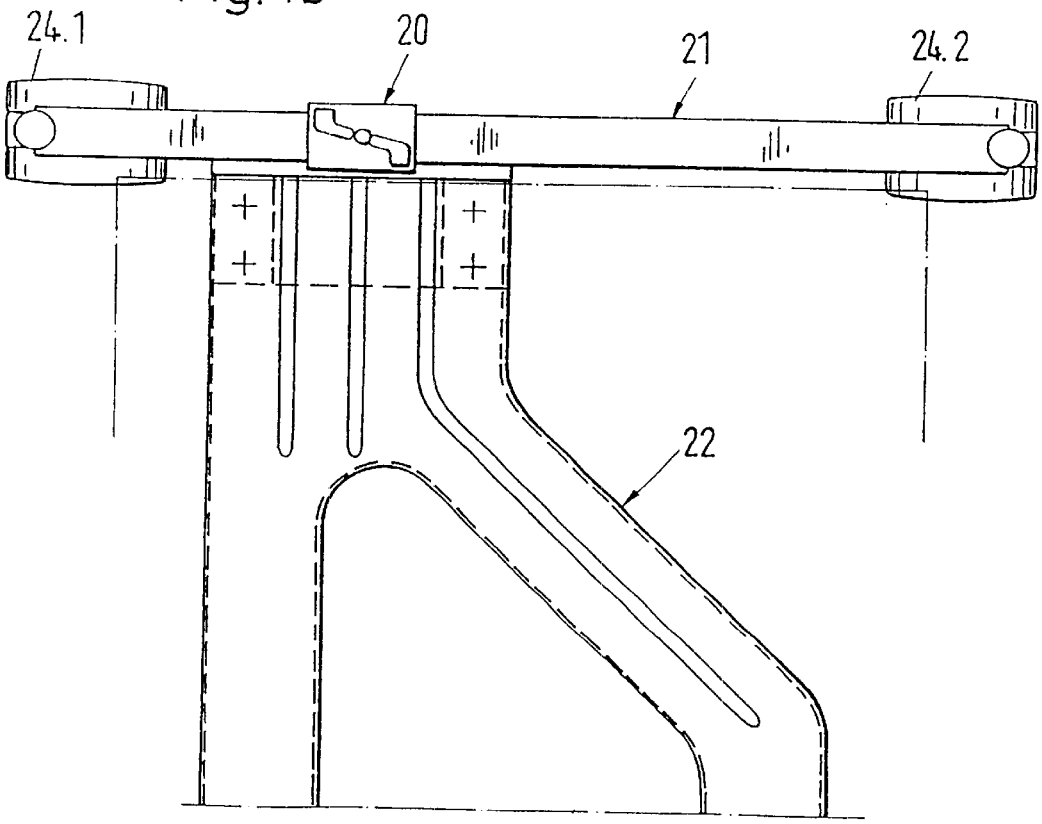

FIGS. 4*a, b* are intended to explain a possible version of the chassis in greater detail. This consists, for example, basically of two side-supports (in FIGS. 4*a, b* only one is shown and marked with reference 21) and one cross-support 22. The chassis (side-support 21 and cross-support 22) is basically H-shaped, with the cross-support 22 in the example not being inserted in the middle, but towards one of the ends of the side support 21.

On the ends of side-support 21, articulating rollers 24.1, 24.2 are installed (as we are familiar with on furniture or office chairs on wheels). The rollers 24.1, 24.2 can be equipped, if so desired, with brakes or locking devices. The lengthwise sleepers 20, for example, are connected rigidly with the side-supports 21 via suitable robust connecting pieces 23.

The closed frame is installed as a whole on a chassis as described.

Figure 17:
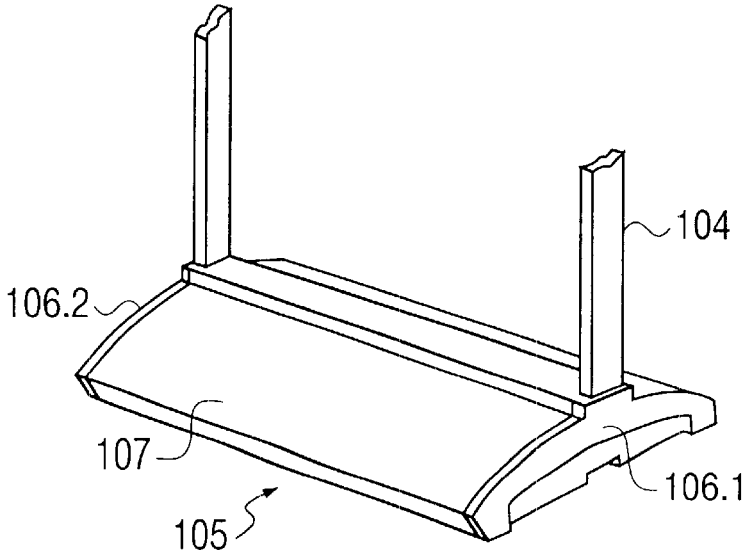
FIG. 17 Is an illustration of a bottom plate.

FIG. 17 shows a bottom plate 105, which can be used as a foot base instead of the H-shaped chassis. It is basically formed by two side-supports 106.1, 106.2 and a cover 107. The side-supports 106.1, 106.2 are affixed to the frame 104 (on its lower corners). The cover fills in the space between the side-supports 106.1, 106.2. If several frames with bottom plates are set up in a line next to each other, the impression of a continuous plate is generated.

It is not required (and in part for space reasons not even possible) that all frames that are set up have a chassis as described for stabilization purposes. Therefore, the interior fittings system also includes a corner connection, which makes it possible to connect neighboring frames with each other on the corners, for example, or lengthwise sleepers. Thus, a second frame without chassis can be added to a frame with chassis (in this case, two vertical lengthwise sleepers will be located right next to each other). It is also possible to set up several frames at an angular position to each other with corner connections so that reciprocal stabilization is generated without making a chassis necessary. When connecting the frames only on the corners, the lengthwise sleepers are freed up for fastening the desired functional elements.

Figure 5A:
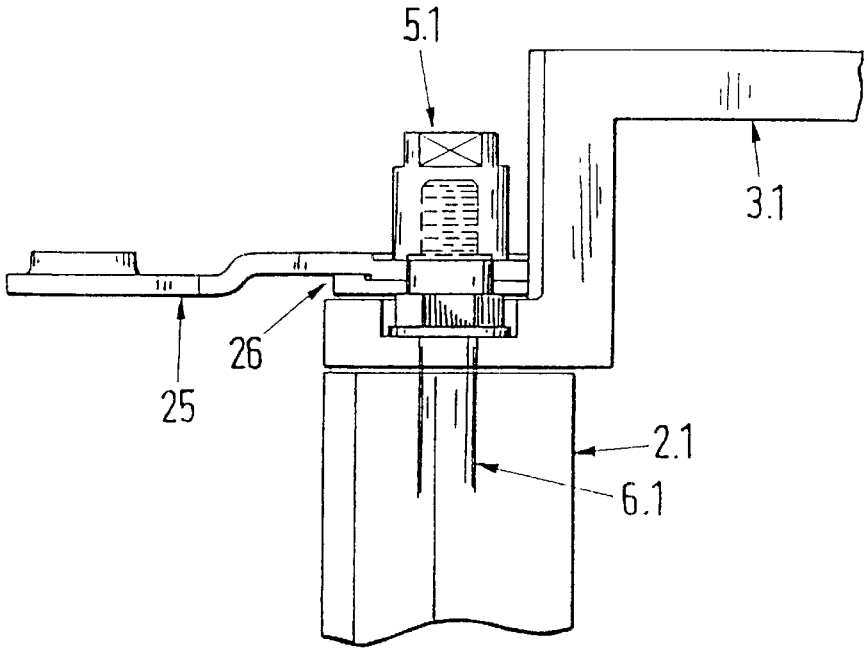
FIGS. 5*a, b* Is an illustration of a corner connection from the side view and the top view.
Figure 5B:
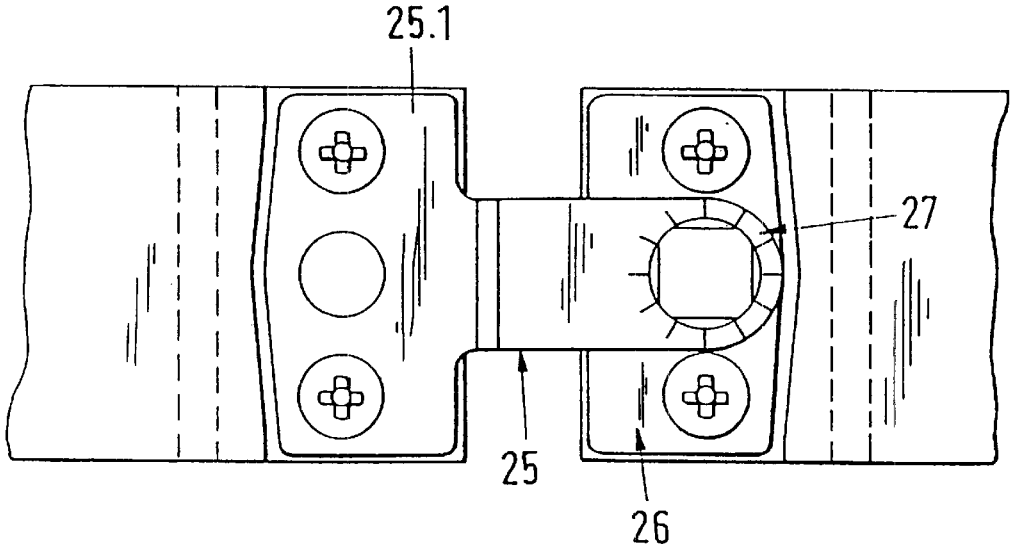

FIGS. 5*a, b* show a simple version of a corner connection 25. Basically, it is a (T-shaped) plate that can be tightened at a selected angular position with the screw 5.1. The corner connection 25 has, for example, three bores in its anchoring part for twist-resistant bracing on the upper corner of a second neighboring frame. A tab 25.2 with a bore (for the screw 5.1), which is formed by the corner connection 25, produces the connection to the first frame.

The corner connection can additionally be equipped with a grid 27 that enables connection of the two frames, e.g., in a 30° grid. The grid 27 can be realized by screwing a fastening plate 26 onto the bow 3.1; the plate has ribs or grooves which merge with appropriate grooves or ribs of the corner connection 25.

Figure 9A:
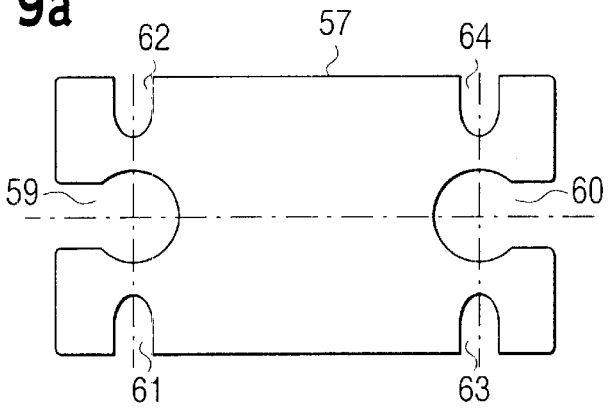
FIGS. 9*a–b* Is an illustration connecting pieces with fixed angles.
Figure 9B:
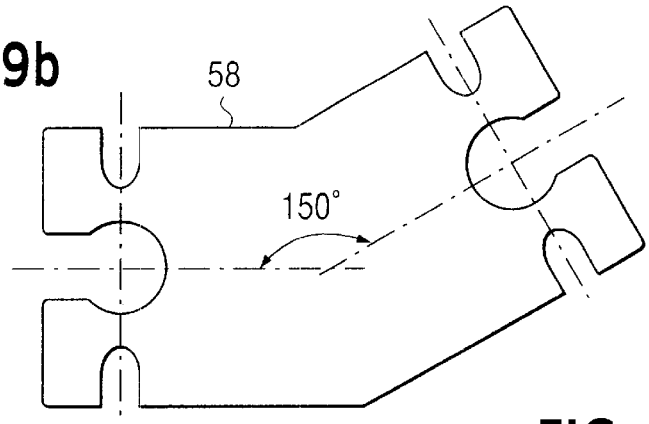

FIGS. 9*a* and 9*b* show two connecting pieces 57, 58 with fixed angles—as an alternative to the connection with variable angles just described. With the connecting piece 57 only straight (i.e. 180°) corner connections and with the connecting piece 58 only 150° corner connections can be established. On the opposing ends, respectively, a recess 59, 60 with a narrowed opening is arranged. The furniture system has, for example, an entire set of fixed connecting pieces with different angles (e.g. 180°, 165°, 150°, 135°, 120°) available.

Figure 10:
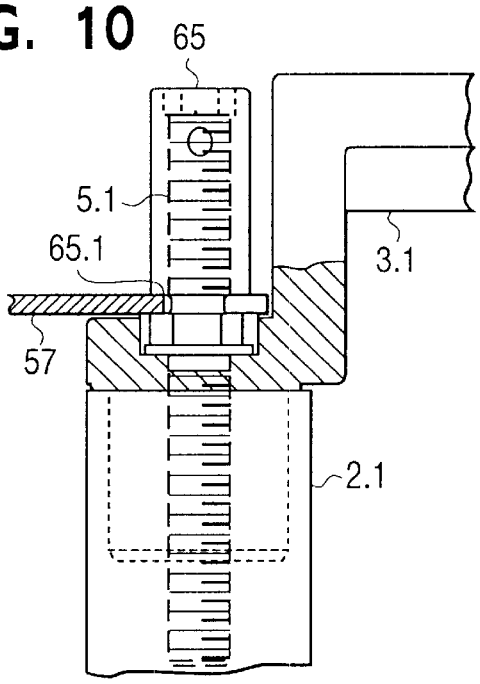
FIG. 10 Is an illustration of a corner connection on the upper corner of the frame.
Figure 11A:
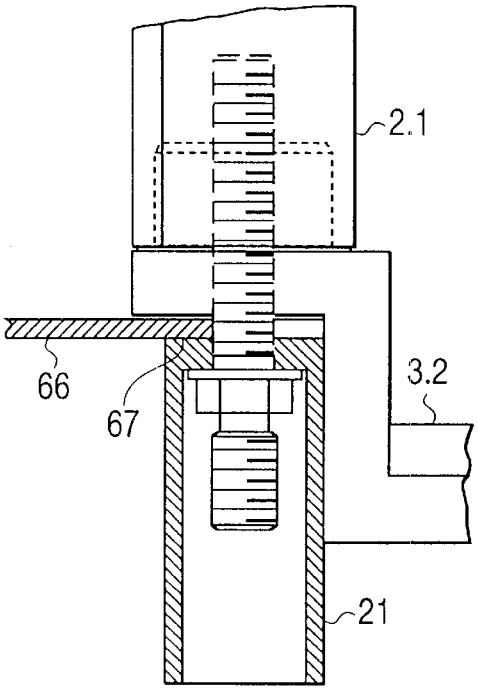
FIGS. 11*a–b* Is an illustration of two profiled sketches of a corner connection on a lower corner of the frame.

FIG. 10 and FIGS. 11*a, b* clarify how the plate-shaped connecting piece 57 is affixed to one corner of the frame. The connecting bolt 5.1 (see also FIG. 1) runs through the recess 60. The fastening cap 65 put on the connecting bolt 5.1 has a section 65.1 with reduced cross-section at its lower end. This section 65.1 fit exactly into the recess 60. The narrow area on the opening of the recess 60 thus prevents the connecting piece 57 from being pulled away vertically to the axis of the connecting bolt 5.1. The narrow area, however, is slightly wider than the diameter of the connecting bolt's 5.1 thread part. Therefore, to insert the connecting piece the fastening cap does not have to be unscrewed completely; it is sufficient if it is loosened or unscrewed, depending on the thickness of the connecting piece 57, until the narrow area can be slid underneath the section 65.1 and then the reduced section lowered into the recess 60. Due to the narrow area, the corner connection cannot loosen even if the connecting bolt 5.1 or 5.2 should become loose.

On the lengthwise sides of the connecting piece 57 further recesses 61 through 64 are provided for, which can also or alternatively be used to secure the corner connection. A particularly preferred way of securing the connection consists of inserting moveable spring locking elements into one of the side recesses 61 through 64 when the connecting piece 57 is slid in its place.

This is to be explained with the help of FIGS. 11*a, b*. They show the corner connection on the lower end of the frame. The connecting piece 66 (which is shown e.g. in FIG. 9*a* ) is inserted on the lower corner of the frame, between the bow 3.2 (see also FIG. 1) and the side-support 21 of the chassis (see also FIGS. 4*a, b*). In order to facilitate assembly, the side-support 21 has a shallow indentation 67. It is just large enough for the flat connecting piece 66 to find room with little play. The width of the connecting piece 66 and thus the width of the indentation 67 is smaller than the width of the bow 3.2. This means that the bow 3.2, and therefore the entire frame, do not rest on the connecting piece 66, but rather on the non-indented upper side of the side-support 21. This offers the advantage that a corner connection can be set up with little effort even if the frame is already mounted to the chassis. The connecting piece 66 can be slid easily into the slot formed by the indentation 67 between the side-support 21 and bow 3.2. To fasten the connecting piece 66 in the slot, an integrated spring locking element 75 is provided for in the side-support 21, which can snap-fit into a side recess (see FIG. 9*a*: 64 or 65) of the connecting piece 66.

Figure 11B:
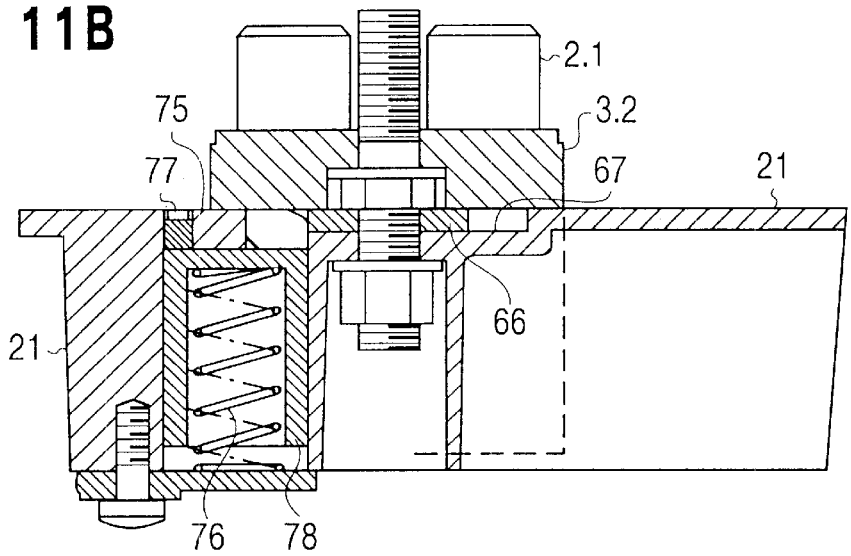

As can be seen particularly in FIG. 11*b*, the indentation 67 has an opening through which a grid element 75 protrudes upward. It is seated on a movable cap 78, which is pushed up by a spring 76. The grid element 75 is shaped in such a way that it can be pushed down by the connecting piece 66 when sliding it into the slot and snaps upward as soon as it reaches the side recess (see reference 63 in FIG. 9*a*). The connecting piece 66 is thus locked into the indentation 67.

In order to be able to loosen the locked position if required, another opening is provided for next to the indentation 67 for an unlocking button 77. The button can, for example, be pushed down with a screwdriver, with the cap 78 with the grid element 75 being lowered at the same time. The connecting piece 66 is thus released.

Figure 6:
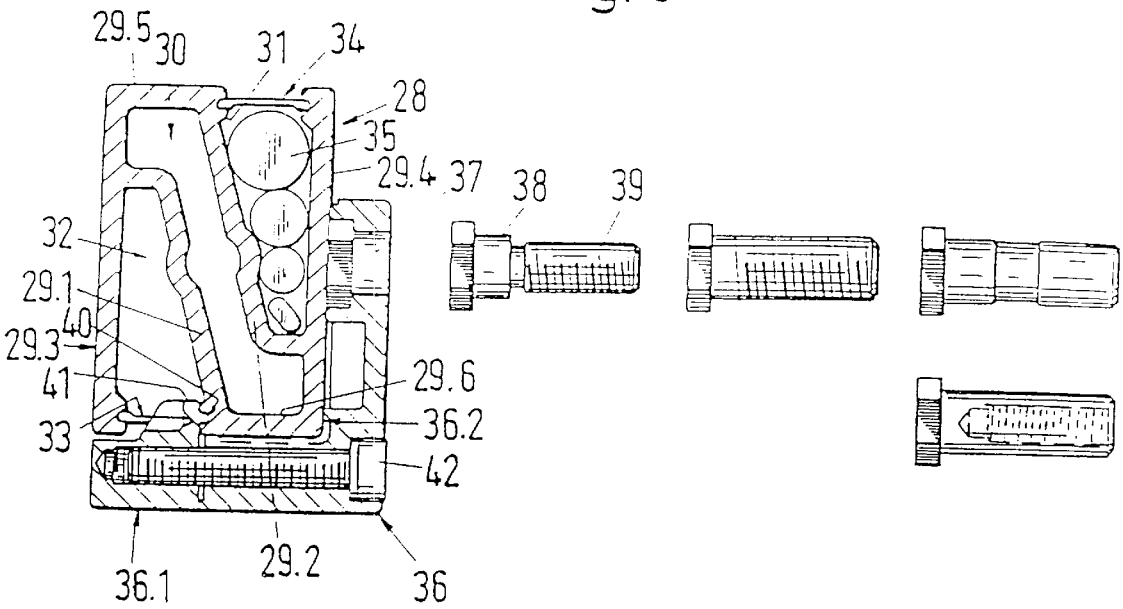
FIG. 6 Is an illustration of a frame profile and a fastening clamp.

FIG. 6 depicts a preferred version of the lengthwise sleeper's profile. In its outer dimensions (outer walls 29.3 to 29.6), the profile 28 is basically rectangular. Its set-up is S-shaped or Z-shaped. Two parallel walls 29.3, 29.4 are connected by diagonal walls 29.1, 29.2. In the example presented, an enclosed (in its cross-section) hollow space 30 is created between the walls 29.1, 29.2.

Between the walls 29.1 and 29.3 or 29.2 and 29.4, respectively, V-shaped open conduits 31, 32 are formed. The respective opening of a conduit consumes about half of the narrow side of the profile 28. In the conduits 31, 32 cables 35 or wires can be inserted, if necessary (e.g. for electrical supply or data communication).

The wires can be firmly integrated in the respective conduit. For example, a plastic carrier with sunken conductors can be affixed on the one interior side of the conduit. I.e., all current-carrying conductors are arranged (sunken) in the same side wall of the conduit. This prevents both conductors from being accidentally touched.

The strip-shaped openings (walls 29.5, 29.6) of the conduits 31, 32 can, for example, be shut with covers 33, 34 (out of plastic, sheet metal etc.) in aesthetically appropriate ways.

Figure 8A:
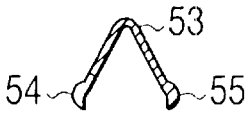
FIGS. 8*a–c* Is an illustration of a V-shaped cover of a cable conduit.
Figure 8B:
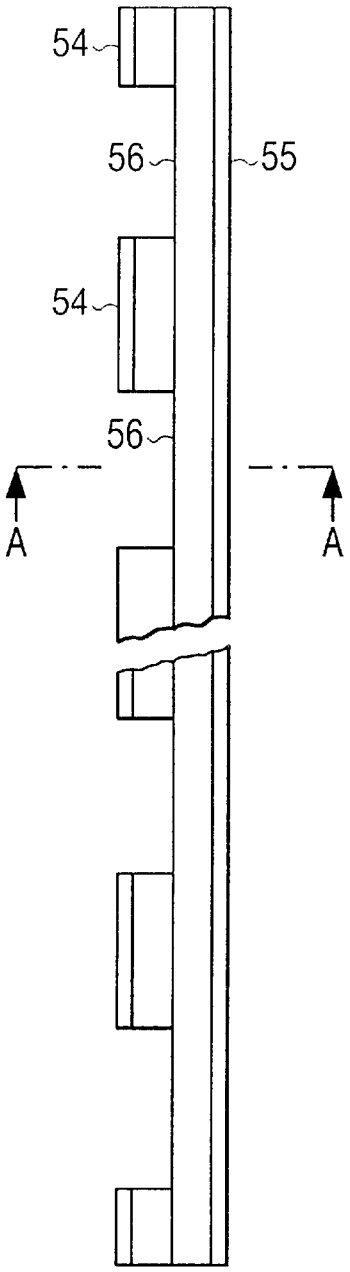
Figure 8C:
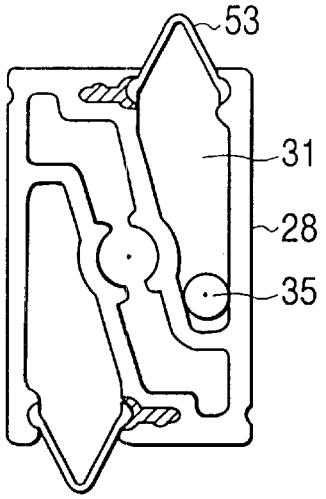

FIGS. 8*a* through 8*c* show a preferred kind of the cover 53. It is v-shaped in its cros-ssection. The two lengthwise edges 54, 55, which are designed thicker, can be pressed against each other to insert the cover 53. One of the two flanks, which together form a V, of the cover 53 is equipped with openings 56 at regular intervals. Through these, the conduits 35 can be guided out of the lengthwise conduit 31 of the profile 28.

In the following, we are again referencing FIG. 6. To fasten functional elements (small tables, presentation storage areas, fastenings etc.) clamping elements 36 can be provided for, which catch the opening of the conduit 32 and can be screwed on at any selected height. Such a clamping element 36 can, for example, consist of two parts 36.1, 36.2.

With a jaw 41 the part 36.1 catches the conduit 32 and then a groove 40. The part 36.2 is angular or L-shaped so that it rests against the walls 29.4, 29.6 from the outside. The part 36.1 is fastened with a sunken screw 42 in the part 36.2.

The leg of the part 36.2 that rests against the wall has a recess 37 for a nut 38. A threaded bolt 39, for example, can be screwed into the nut 38, which is held twist-resistant in the recess 37. (The element that is to be affixed can then be screwed onto this threaded bolt 39.)

The profile shown in FIG. 6 is very stable and durable. It unites mechanical/static and aesthetic advantages. The edges of the conduit openings can possibly be equipped with fine teeth in order to enable higher durability of the fastened clamping elements 36.

Instead of the recess 37, the nut 38 and the threaded bolt 39, the clamping element 36 can also be equipped with two pins that protrude to the outside, on which a coupling block can be put and screwed. Such a design is particularly suited for fastening a work lamp. Of course many other useful pieces of work equipment and aids can be affixed to the frame in this simple manner. This is in accordance with the goal to make a modular and simultaneously diverse interior fittings system available.

The wall 29.4 is on the inner side of the frame, the wall 29.3 is on the outer side of the frame, and the two walls 29.5, 29.6 are located on the face sides (i.e. front and back) of the frame.

Figure 12:
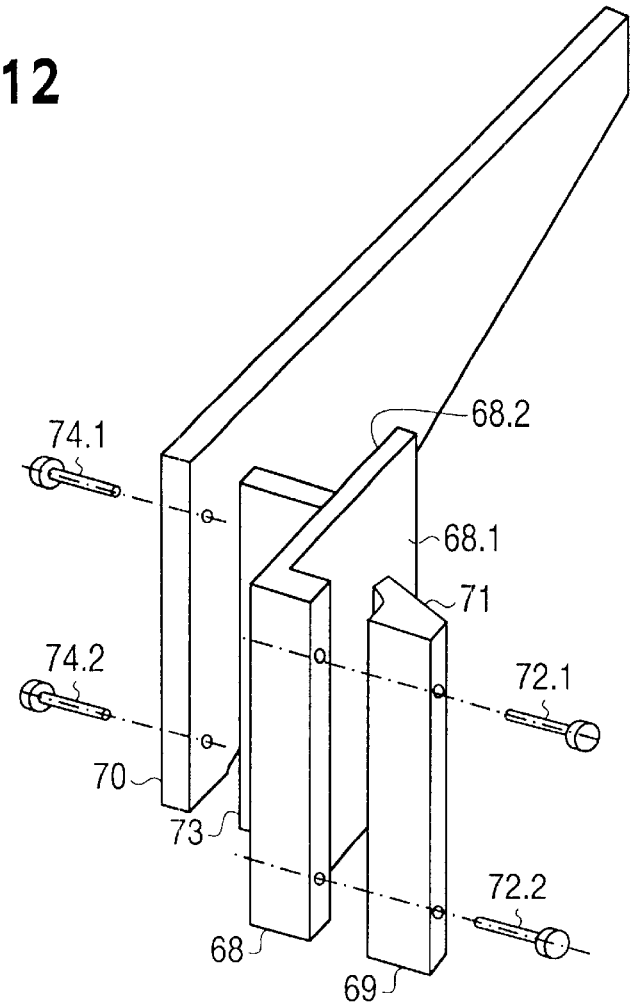
FIG. 12 Is an illustration of a fixture to fasten a table top on the vertical lengthwise sleeper of the frame.

FIG. 12 depicts a possible design for the fastening of a table top on a profile in accordance with FIG. 6. The fastening fixture comprises an anchor plate 68, a clamping element 69 and a support 70. The anchor plate's 68 inner side 68.1 is placed on the wall of the profile that is located on the frame interior (see wall 29.3 or 29.4 in FIG. 6). The clamping element 69 is equipped with a rib 71, which can catch the conduit 31 (see FIG. 6) of the profile. The clamping element 69 is affixed to the anchor plate 68 with screws 72.1, 72.2. Large surfaces of the anchor plate 68 and clamping element 69 rest on the profile and thus ensure very stable fastening.

The outer side 68.2 of the anchor plate 68 has a plate-shaped connecting piece 73. It is arranged in the plane created by the frame. The support 70 is affixed to the connecting piece 73 with screws 74.1, 74.2. The support 70 forms a right angle with the connecting piece 73, i.e. it protrudes vertically from the vertical plane created by the frame.

In accordance with FIG. 12, the support 70 is connected rigidly with the frame. Its upper side runs horizontally if the table top that is supposed to be mounted on it should be horizontal. Of course the table top can also be installed at an angle, i.e. inclined, using the same principle. It is sufficient to use an appropriately shaped support for that application.

One advantage of the design described in FIG. 12 consists of having the possibility of mounting it also mirror-symmetrically—by utilizing the first elements mentioned above. Thus, no "left" or "right" table supports have to be made available.

In the following, a preferred version of bracing a container on the chassis will be explained.

Figure 13A:
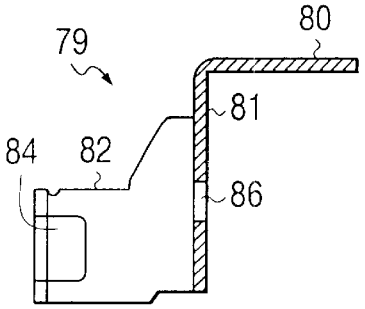
FIGS. 13*a–c* Is an illustration of support element's cross-section, front view and top view.
Figure 13B:
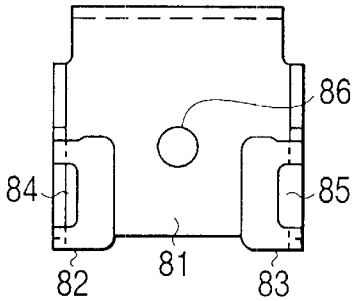
Figure 13C:
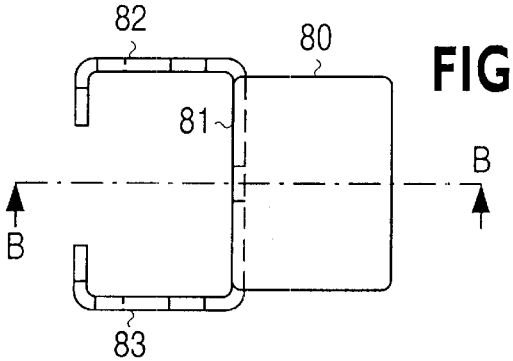
Figure 14A:
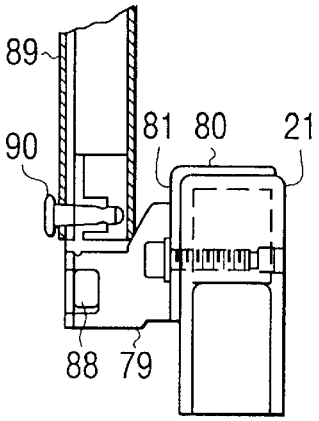
FIGS. 14*a, b* Is an illustration of a support element fastened on the chassis.

FIGS. 13*a–c* show a support element 79 in its cross-section, front view and top view. It is bent, e.g., out of a piece of steel sheet and has a back wall 81, a strap 80 and two flanks 82, 83. The back wall 81 is equipped with an opening 86 to be able to screw the support element 79 to the side of the side support 21. The strap 80 is located on the upper end of the back wall 81 and protrudes to the back horizontally at a right angle towards the back wall 81. During assembly of the support element 79 on the side support 21, the strap 80 rests on top of the side support 21 (see FIGS. 14*a, b*). The flanks 82, 83 together with the back wall 81 form a profile that in its top view is C-shaped. They are bent forward at a 90° angle and form vertical surfaces. Both have an opening 84 or 85.

Figure 14B:
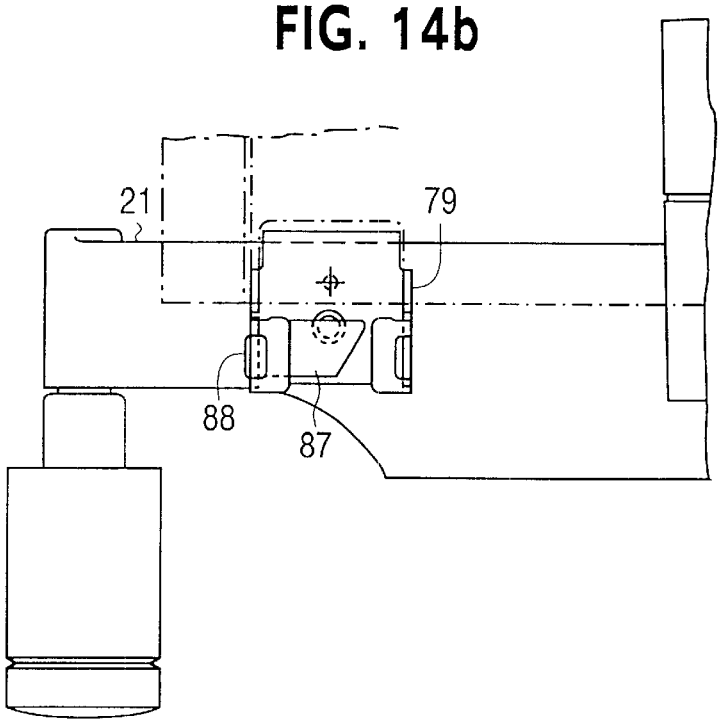

FIG. 14 shows how the support element 79 is mounted. In the free space enclosed by the C-shaped profile, a connecting journal 87 can be inserted. The journal has a lug 88 which snaps into one of the two openings 84, 85. A frame tube 89 of the container is placed on the connecting journal 87. The frame tube 89 is fastened on the connecting journal 87 with a pin 90. It is now clear that the lug 88, which snaps into the openings 84 or 85, prevents the container from being lifted from the chassis.

Therefore, the support element has to ensure a simple but statically stable connection between the container and the chassis (foot base). It can be made out of metal or polymer. Furthermore it is clear that such a connection can also be obtained differently. The container can then, for example, be screwed directly together with the foot base.

Figure 15:
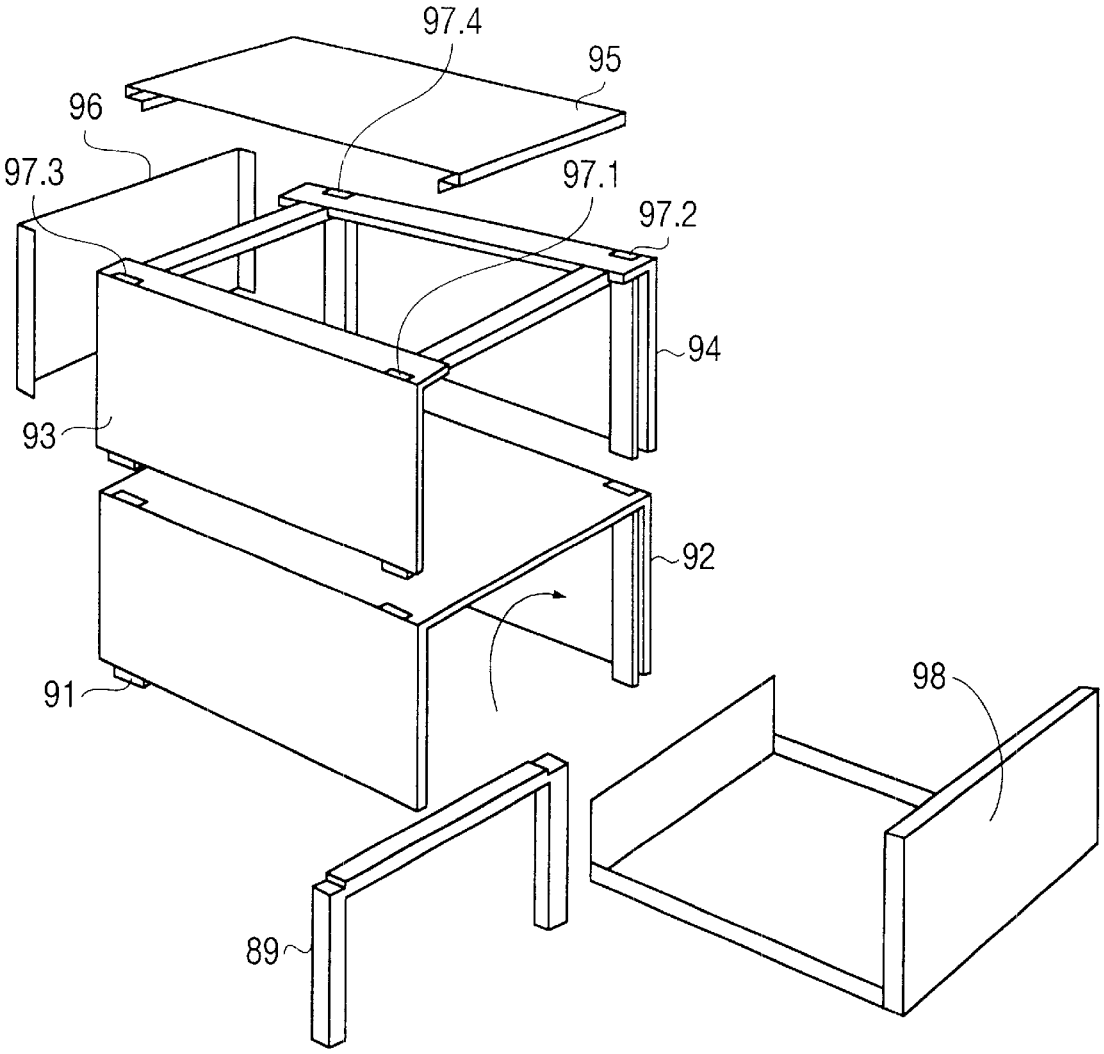
FIG. 15 Is an illustration of a modular container.

FIG. 15 depicts a particularly preferred version of a modular container. Several containers of the same kind can be stacked on top of each other. The one on the very bottom can be fastened to the chassis in the manner just described.

Each container consists of two frame tubes 89, 91 and a cover 92. The frame tubes 89, 91 both have two vertical sections and one horizontal section on their upper ends. The frame tube 89 or 91 is therefore designed like a C-shaped bow. The cover 92 is assembled from two symmetrical side walls 93, 94, an upper side 95 and a back wall 96. The described parts of the cover should preferably be connected to each other by pushing them together.

Openings 97.1 through 97.4 are provided for in the cover 92 or the angled upper edges of the side walls 93, 94. Openings also exist in the appropriate locations of the frame tubes 89, 91 located underneath. In these openings, connecting journals can be inserted in the same way as the support element 79. In other words: Just as the frame tubes are connected with the support elements, the frame tubes can also be connected with the various container modules.

On the interior of the frame tubes 89, 91, e.g, rails are fastened in which a drawer 98 can run. Furthermore it is recommended to provide for a mechanism that prevents all drawers of a multi-layer container from being opened simultaneously. (These mechanisms are already known as such.) It is advantageous if this mechanism is set up in a modular fashion like the container. In other words: each module includes a part of the described mechanism, and when setting the container modules on top, the various parts of the described mechanism connect with each other (e.g. similar to a plug system).

Figure 16:
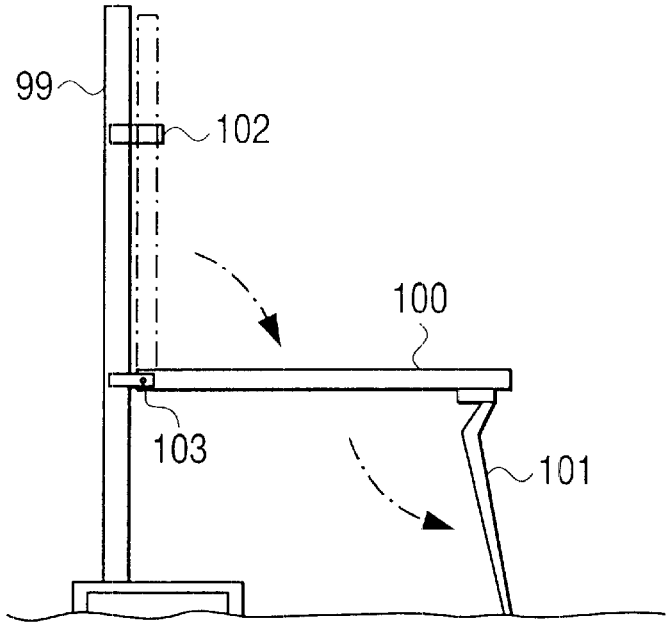
FIG. 16 Is an illustration of a folding table integrated into the frame.

As can be seen from FIG. 16, the frame according to the invention is also suited for folding table designs. In the vertical frame 99, a joint 103 can be mounted. It is preferably located in the frame plane. The joint 103 carries a table top 100 on one end. On the other end of the table top 100, foldable legs (folding in and out) 101 are attached. When the table top 100 is brought from the horizontal position shown in FIG. 16 into a vertical position (as is also hinted in the sketch) it can be fixed with a locking device 102.

The fully swiveling seating of the table top does not have to be on its end. It is absolutely possible as well to attach a joint to the middle section of the table top's lengthwise sides. In vertical position, a part of the table top will protrude downward beyond the joint. This provides a counterbalance which facilitates the handling of the folding table.

In a modified form of the version shown in FIG. 16, two tables can also be planned in a mirror-symmetrical manner towards the frame 99. If fastening occurs on the frame in its plane, it will of course no longer be possible to fold the tables up. When fastening the system outside the frame plane, however, it is possible to plan for two non-interfering joint arrangements.

It is beneficial if the table top can be completely detached from the joint arrangement with just a few moves. The tables can then be stacked in a separate location and save space.

Figure 7:
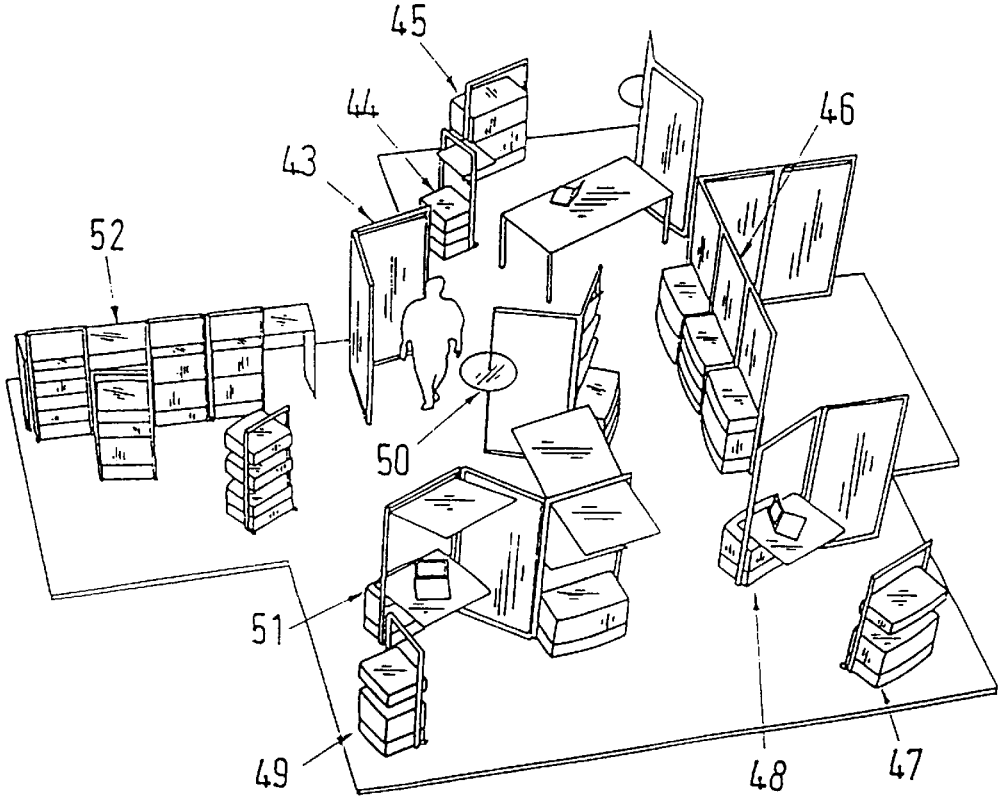
FIG. 7 Is an illustration example of interior fittings with several work places based on the fittings system according to the invention.

FIG. 7 illustrates a few possibilities concerning the realization of functional units with the interior fittings system according to the invention.

Two vertical frames with inserted acoustic panels (for sound proofing) can form a separating wall 43. The required stability can be ensured by setting the frames up at an angle to each other (utilization of corner connections).

A mobile unit 44 can, for example, consist of a carcass in the lower part of the frame and a work surface (at the height of a high desk).

Personal carcasses 45, 47, 49 can be available in larger numbers within an office set-up (e.g. one for each member of a team).

Several frames can also be arranged next to each other in a line to form a larger room divider 46. Some of the frames can be equipped with carcasses (stabilization, storage area), as needed.

Computer work places 48, 51 can, e.g., be set up with two or three structural elements. The computer workstation 48 consists of a work surface, a carcass arranged underneath (as shown in FIG. 2 for example) and a separating wall mounted on the side. The computer workstation 51 basically offers two people a desk of their own. Frames equipped with the work surfaces are connected with a separating wall for stability reasons and at the same time visually separated.

On the computer workstation 51 anti-glare surfaces are shown which, for example, are installed in the frame underneath the upper cross-bow. Such an anti-glare device can, e.g., block bothersome light on a computer monitor. Similarly it is possible to provide for a reflector for individual lighting of the work place. The reflector, for example, is illuminated by a light source affixed to the frame and ensures diffused lighting of the computer workstation.

It is useful if the anti-glare device or reflector can be mounted anywhere on the frame (e.g. on the side sleepers). A preferred type of a lighting fixture's integration consists of arranging it above the upper bow. Preferably the lighting fixture has the same length as the bow and is screwed to the upper corners of the frame. It only sends its light rays upward (indirect lighting). In order to ensure such a lighting fixture's quality independent of the room height, a reflector can be installed above the lighting fixture (e.g. a plastic shield), which is supported by a delicate wire design on the upper corners of the frame as well.

The various carcasses can be placed in a storage area 52 ("docking station") specifically designed for this purpose if they are not used.

Finally, also a coffee bar 50 with a small round table and a newspaper stand (presentation rack) is shown.

FIG. 7 clarifies that the most diverse interior fittings elements can be set up. The entire arrangement is very flexible because it does not require any fixed installations and is designed in a modular fashion. It is possible to set up the various elements at a later time in a different arrangement and in different combinations. The structural and visual unity is created by the rectangular frame. In the described example, the system is limited to a large frame for separating walls, room dividers, computer workstations etc. and small frames for mobile carcass elements.

On the vertical lengthwise sleepers basically any functional elements (monitor fastening fixtures, lamps, etc.) can be installed.

Of course, application possibilities of the interior fittings system according to the invention are not limited to office area. Many application opportunities result from the automated or personal service areas, the semi-public or public sector or also the production area. We might also mention, e.g., communication terminals (from a simple telephone box to computer terminals for international network access) or discussion, meeting or waiting areas that can be created with the help of separating walls, presentation surfaces, storage surfaces, video display devices, etc.

With regard to design, the vertical frame forms the basis of the fittings system as a structural element. By utilizing surfaces and volumes different functional-specific requirements can be met (desk, stand-up table, tilting surface, wall element, draft screen, acoustical element, projection surface, pin board, container volume for office utensils, books and files, technical volume for equipment). As needed, lighting fixtures can be mounted for direct or indirect lighting of the work place as well as cables for the electrical supply of equipment and lamps in or on the frame. A certain frame's stability is guaranteed by appropriate corner connections or bows. Additional stability can be achieved with brackets, the appropriate arrangement of box elements (in the bottom section of the frame) or through the angled connection of several frames. Surfaces hung horizontally into the frame serve as storage and work surfaces. Their positioning occurs, for example, with pre-specified grids in the profile track or, if so desired, through electrical or manual, infinitely variable height adjustments in the profile. If necessary, tilting features of the surfaces can be provided for as well. Vertical surfaces like visual protection and sound proofing elements are clamped into the frame.

The interior fittings system in accordance with the invention can be used to supplement existing furniture arrangements without difficulty. It should also be mentioned that, for example, it can be combined with computer furniture that is not based on the invention's frame.

Naturally the examples shown in the sketches primarily serve the purpose of explaining the concept. The frame elements, chassis and brackets, the profile shape of the lengthwise sleepers and the corner connections can be executed differently as well. In particular, the frame does not have to consist of straight lengthwise sleepers and cross-bows. Important, however, are stability, modular features and the visual and functional uniformity of the structural elements.

The invention's characteristic element is the vertical frame. It unites the different functional units both mechanically and aesthetically. Basically, any frame can be used by itself. As FIG. 7 shows, the utilization of a number of the same frames results in an interior fittings system where the various functional units are placed in reciprocal reference both with regard to design and also visually.

The interior fittings system always has two or more different functional units (work surfaces, carcasses, shelves, etc.). They can be assembled in various ways into furniture, with the same overall impression being conveyed to the observer despite the differences regarding the functional units. Additionally, other units—quasi in blocks—can be added without changing the overall impression considerably.

An important feature of the invention consists of the fact that the functional units are always mounted in the closed frame in such a way that they reach through the plane defined by the flat vertical frame. One advantage of this layout is that the strain of the frame is more or less central, i.e. each unit's center of gravity is near or even within the frame. It should not remain unmentioned that assembly of the functional units according the invention also provides an exceptionally aesthetic effect.

The central and characteristic structural element of the furniture system is formed—as already mentioned—by the statically stable, closed vertical frame. It basically consists of two vertical lengthwise sleepers and two bows that rigidly connect the lengthwise sleepers on the upper and lower ends. The advantage of this fundamental design consists, for example, of the low space requirement. Furthermore, this design results in a sort of symmetry, which enables the beneficial connection of several frames of the same kind.

With the structural elements according the invention, the most diverse layout shapes can be realized. There is basically no fixed angle between neighboring frames (even if a more or less detailed grid can be of advantage in some individual cases).

What is claimed is:

1. A modular interior furniture add-on system comprising:

a plurality of functionally different units, at least one uniformly designed structural element having a static load-bearing capacity, said at least one structural element which defines a frame and is a vertical, closed rectangular frame defining a plane of the frame, said frame essentially consists of two vertical support posts and two tie bars horizontally connecting the vertical support posts, a bottom support element oriented perpendicular to the plane of the frame attached at the lower end of the frame for supporting the frame, wherein the bottom support element forms an H-shaped form in a plane that is vertical to the frame plane, the functional units being mounted to the frame so that they project through the plane defined by the frame, each at least one structural element forms a stand-alone frame that is independent with respect to its vertical support posts and its horizontal tie bars from any neighboring frame.

2. The modular furniture add-on system according to claim 1 further including means for establishing a corner joint for connecting the frame to an adjacent similar frame so that the corner joint can be loosened if required.

3. The modular interior furniture add-on system according to claim 1 wherein at least one functional unit is a table.

4. The modular interior furniture add-on system according to claim 1, wherein the frame has lengthwise sleepers with grooves or ribs to fasten the functional units at any selected height.

5. The modular interior furniture add-on system according to claim 1, wherein the frame is equipped with conduits for containing cables and/or wires.

6. The modular interior furniture add-on system according to claim 1, wherein the frame has an S-shaped or Z-shaped profile.

7. The modular interior furniture add-on system according to claim 1, further including a screw assembly.

8. The modular interior furniture add-on system according to claim 1, wherein means are provided for the corner joint to ensure the connection of the similar frame at selected various angle positions.

9. The modular interior furniture add-on system according to claim 1, wherein the functional units are selected from the group consisting of work surfaces, separating wall boards, lighting fixtures, reflector elements, anti-glare elements, presentation racks, monitor fastening devices or equipment fastening devices.

10. The modular interior furniture add-on system according to claim 1, wherein at least one of the plurality of functional units is a modular carcass.

11. The modular interior furniture add-on system according to claim 10, wherein the carcass is supported on a shaft.

12. The modular interior furniture add-on system according to claim 1, wherein at least one structural element has a folding table mounted in the frame and wherein the folding table can be fixed by a locking device when it is brought from a horizontal position into a vertical position.

13. The modular interior furniture add-on system according to claim 1, comprising a modular container constructed such that several containers of the same type can be stacked on top of each other.

14. The modular interior furniture add-on system according to claim 13, wherein the modular container comprises a container frame with two vertical sections and one horizontal section to be designed like a C-shaped bow, a cover assembled from two side walls an upper side and a back wall, openings in the container frame and in the cover at corresponding locations for inserting connecting journals to allow stacking several containers on top of each other.

15. The modular interior furniture add-on system according to claim 14, wherein the container frame can be fixed by means of journals in the fixing elements mounted on at least one side support of the H-shaped design in the same way as several containers can be stacked on top of each other.

16. The modular interior furniture add-on system according to claim 1, wherein containers are fixed to the bottom support element by means of fixing elements mounted on at least one side support of the H-shaped design.

17. The modular interior furniture add-on system according to claim 16, wherein the fixing elements have an opening for a lug of a connecting journal preventing the containers to be lifted from the bottom support element.

18. The modular interior furniture add-on system according to claim 15, wherein the container frame can be fixed by means of journals in the fixing elements mounted on at least one side support of the H-shaped design in the same way as several containers can be stacked on top of each other.

19. A modular interior furniture add-on system comprising:

a plurality of functionally different units several uniformly designed structural elements each defining a frame of a first type having a static load-bearing capacity, at least one uniformly designed structural element defining a frame of a second type, said structural elements of the first and the second type being each a vertical, closed rectangular frame defining a plane of said rectangular frame, wherein the structural elements of the first type are larger frames than the structural elements of the second type, said frames essentially consist of two vertical support posts and two tie bars horizontally connecting the vertical support posts, a bottom support element oriented perpendicular to the plane of each of the frames attached at the lower end of the frame for supporting the frame, wherein the bottom support element forms an H-shaped design in a plane that is vertical to the plane of said rectangular frame, the functional units being mounted to the frame so that they project through the plane defined by the frame, each at least one structural element forms a stand-alone frame that is independent with respect to its vertical support posts and its horizontal tie bars from any neighboring frame, the structural element of the second type carrying a carcass reaching through the plane of the frame.

20. The modular interior furniture add-on system according to claim 19 comprising a lamp on top of the vertical, closed rectangular frame of at least one of said structural elements of the first type.

21. The modular interior furniture add-on system according to claim 19 comprising reflector elements or anti-glare elements mounted on the top end of the vertical, closed rectangular frame of at least one of said structural elements of the first type.

22. The modular interior furniture add-on system according to claim 19, wherein the structural element of the second type has a chassis with rollers in order to be mobile.

23. The modular interior furniture add-on system according to claim 19, wherein at least one structural element of the first type has a folding table mounted in the frame and wherein the folding table can be fixed by a locking device when it is brought from a horizontal position into a vertical position.

24. The modular interior furniture add-on system according to claim 19 comprising a modular container constructed such that several containers of the same type can be stacked on top of each other.

25. The modular interior furniture add-on system according to claim 24, wherein the modular container comprises a container frame with two vertical sections and one horizontal section to be designed like a C-shaped bow, a cover assembled from two side walls an upper side and a back wall, openings in the container frame and in the cover at corresponding locations for inserting connecting journals to allow stacking several containers on top of each other.

26. The modular interior furniture add-on system according to claim 25, wherein the container frame can be fixed by means of journals in the fixing elements mounted on at least one side support of the H-shaped design in the same way as several containers can be stacked on top of each other.

27. The modular interior furniture add-on system according to claim 19, wherein containers are fixed to the bottom support element by means of fixing elements mounted on at least one side support of the H-shaped design.

28. The modular interior furniture add-on system according to claim 27, wherein the fixing elements have an opening for a lug of a connecting journal preventing the containers to be lifted from the bottom support element.

29. The modular interior furniture add-on system according to claim 27, wherein the container frame can be fixed by means of journals in the fixing elements mounted on at least one side support of the H-shaped design in the same way as several containers can be stacked on top of each other.

30. The modular furniture add-on system according to claim 19 further including means for establishing a corner joint for connecting the frame to an adjacent similar frame so that the corner joint can be loosened if required.

31. The modular interior furniture system according to claim 19, wherein the frame has lengthwise sleepers with grooves or ribs to fasten the functional units at any selected height.

32. The modular interior furniture system according to claim 19, wherein the frame is equipped with conduits for containing cables and/or wires.

33. The modular interior furniture system according to claim 19, wherein the frame has an S-shaped or Z-shaped profile.

34. The modular interior furniture system according to claim 19, further including a screw assembly.

35. The modular interior furniture system according to claim 19, wherein means are provided for the corner joint to ensure the connection of the similar frame at selected various angle positions.

36. The modular interior furniture system according to claim 19, wherein the functional units are selected from the group consisting of work surfaces, separating wall boards, lighting fixtures, reflector elements, anti-glare elements, presentation racks, monitor fastening devices or equipment fastening devices.

* * * * *